US010391379B2

(12) United States Patent
Wilkins

(10) Patent No.: US 10,391,379 B2
(45) Date of Patent: Aug. 27, 2019

(54) TAKEOFF POINT MARKER ASSEMBLY

(71) Applicant: Ronald Wilkins, Bowie, MD (US)

(72) Inventor: Ronald Wilkins, Bowie, MD (US)

( * ) Notice: Subject to any disclaimer, the term of this patent is extended or adjusted under 35 U.S.C. 154(b) by 0 days.

(21) Appl. No.: 15/709,602

(22) Filed: Sep. 20, 2017

(65) Prior Publication Data

US 2018/0078841 A1 Mar. 22, 2018

Related U.S. Application Data

(60) Provisional application No. 62/397,380, filed on Sep. 21, 2016.

(51) Int. Cl.

| | |
|---|---|
| ***A63B 71/06*** | (2006.01) |
| ***G09F 7/18*** | (2006.01) |
| ***G09F 19/22*** | (2006.01) |
| ***A63B 69/00*** | (2006.01) |
| *A63B 71/00* | (2006.01) |
| *A63B 71/02* | (2006.01) |

(52) U.S. Cl.

CPC ..... *A63B 71/06* (2013.01); *A63B 69/0028* (2013.01); *G09F 7/18* (2013.01); *G09F 19/228* (2013.01); *A63B 71/0036* (2013.01); *A63B 2071/009* (2013.01); *A63B 2071/024* (2013.01); *A63B 2071/0694* (2013.01); *A63B 2244/08* (2013.01); *A63B 2244/15* (2013.01); *A63B 2244/16* (2013.01); *A63B 2244/17* (2013.01)

(58) Field of Classification Search

CPC ..... B65D 19/0012; B65D 19/0018; B65D 19/0028; A63C 19/04; A47G 23/0225

See application file for complete search history.

(56) References Cited

U.S. PATENT DOCUMENTS

| | | | | |
|---|---|---|---|---|
| 2,122,266 | A * | 6/1938 | Seys | A63C 19/04 473/499 |
| 2,544,657 | A * | 3/1951 | Cushman | B65D 19/0012 108/53.3 |
| 3,664,272 | A * | 5/1972 | Sanders | B65D 19/0028 108/53.3 |
| 3,709,188 | A | 1/1973 | Coupar | |
| 4,004,800 | A | 1/1977 | Hanner | |
| 4,879,956 | A * | 11/1989 | Shuert | B65D 19/0018 108/52.1 |
| 5,230,297 | A | 7/1993 | Lakatos | |
| 5,441,257 | A * | 8/1995 | Sheaffer | A63B 57/00 116/209 |
| 5,613,458 | A * | 3/1997 | Owen | B63B 21/26 114/230.1 |
| 6,786,349 | B2 * | 9/2004 | Najd | B65F 1/141 220/483 |
| 7,236,257 | B2 | 6/2007 | Rubach | |
| D589,290 | S * | 3/2009 | Hatta | D6/587 |

(Continued)

*Primary Examiner* — Cassandra Davis

(74) *Attorney, Agent, or Firm* — Global Intellectual Property Agency, LLC; Daniel Boudwin

(57) ABSTRACT

A device for marking a starting point on a running track. A plurality of spikes is affixed to a bottom surface of a planar member. A top surface of the planar member can receive print thereon. The plurality of spikes can be inserted into a running track. A plurality of conical covers houses the plurality of spikes when the plurality of spikes is not inserted into a running track. The planar member can be rectangular with a spike disposed in each corner on the bottom surface.

11 Claims, 4 Drawing Sheets

(56) References Cited

U.S. PATENT DOCUMENTS

| | | | | |
|---|---|---|---|---|
| D636,965 | S * | 4/2011 | Stiles | D99/17 |
| 8,087,630 | B1 * | 1/2012 | Matthews | A47G 23/0225 248/156 |
| 8,191,562 | B1 * | 6/2012 | Sampson | A45B 19/04 135/118 |
| 2003/0209171 | A1 * | 11/2003 | Milles | B65D 19/0018 108/53.1 |
| 2011/0253016 | A1 * | 10/2011 | Leakey | B65D 19/0012 108/56.3 |
| 2014/0091100 | A1 * | 4/2014 | Wan | B65F 1/1473 220/636 |

* cited by examiner

TAKEOFF POINT MARKER ASSEMBLY

CROSS REFERENCE TO RELATED APPLICATIONS

This application claims the benefit of U.S. Provisional Application No. 62/397,380 filed on Sep. 21, 2016. The above identified patent application is herein incorporated by reference in its entirety to provide continuity of disclosure.

BACKGROUND OF THE INVENTION

The present invention relates to a track and field marker. Specifically, a planar member that is inserted into a running or vaulting track to mark a spot on the track where an athlete wishes to begin their run, throw or jump.

Several devices have been proposed to mark the takeoff point of an athlete. Typically, track and field athletes utilize strips of adhesive tape to mark their takeoff point, such as first aid tape. These athletes lay the adhesive tape down on the side of the track at the spot they wish to begin their run, throw or jump. This spot is known as the takeoff point.

The typical adhesive tape track and field athletes use to mark their takeoff points can cause confusion between competing athletes due to the lack of personalization present in off-the-shelf adhesive tape. The limiting styles and colors of adhesive tape result in many track and field athletes using the same or very similar takeoff point markers, which, in turn, may cause athletes to takeoff from a spot that has been marked by another athlete. Additionally, adhesive tape is not suitable to use in rainy or humid conditions. In moist conditions, adhesive tape does not stick readily to the surface of a track. Thus, adhesive tape markers can be easily lost or moved when outdoor conditions are not ideal.

Another device used to determine a takeoff point for a track and field athlete is a light beam indicator. A light beam indicator marks the position of a takeoff point from an athlete's jump by detecting a break in a plurality of light beams at the moment an athlete's foot leaves the takeoff surface. Although these devices accurately determine where the takeoff point is located, they fail to provide a mechanism to mark a takeoff point for a future jump. Thus, a device that can mark the takeoff point that can easily transposition, can be used in all weather conditions and can be personalized is desirable.

SUMMARY OF THE INVENTION

In view of the foregoing disadvantages inherent in the known types of track and field takeoff point markers, the present invention provides a track and field takeoff point marker wherein the same can be utilized for providing convenience for the user when marking a takeoff point at a track and field competition no matter the weather conditions. The present system comprises a planar member having a bottom surface opposed to a top surface. A plurality of spikes is affixed to the bottom surface, wherein the spikes are configured to pierce a track surface to allow the planar member to be inserted into a position on the track surface. A plurality of conical covers is configured to removably house the plurality of spikes.

One object of the present invention is to provide a takeoff point marker that is a planar member having a plurality of spikes affixed to a bottom surface thereof, wherein the spikes are configured to be inserted into a surface of a track.

An additional object of present invention is to provide a set of conical covers that houses the spikes affixed to the bottom surface of the takeoff point marker.

Another object of the present invention is to provide a takeoff point marker comprising a rectangular planar member having a top surface capable of receiving customizable print as a personal identifier for a track and field athlete.

Yet another object of the present invention is to provide a takeoff point marker that is a rectangular planar member with four spikes affixed to a bottom surface of the rectangular planar member, wherein each spike is positioned in a corner of the rectangular planar member.

A further object of the present invention is to provide a takeoff point marker that has a planar cover member having inset conical depressions for housing a plurality of spikes affixed to a bottom surface of a planar member, whereby the planar cover member spans the length and width of the bottom surface of the planar member.

Another object of the present invention is to provide a takeoff point marker having a plurality of removable spikes affixed to a bottom surface of a planar member.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
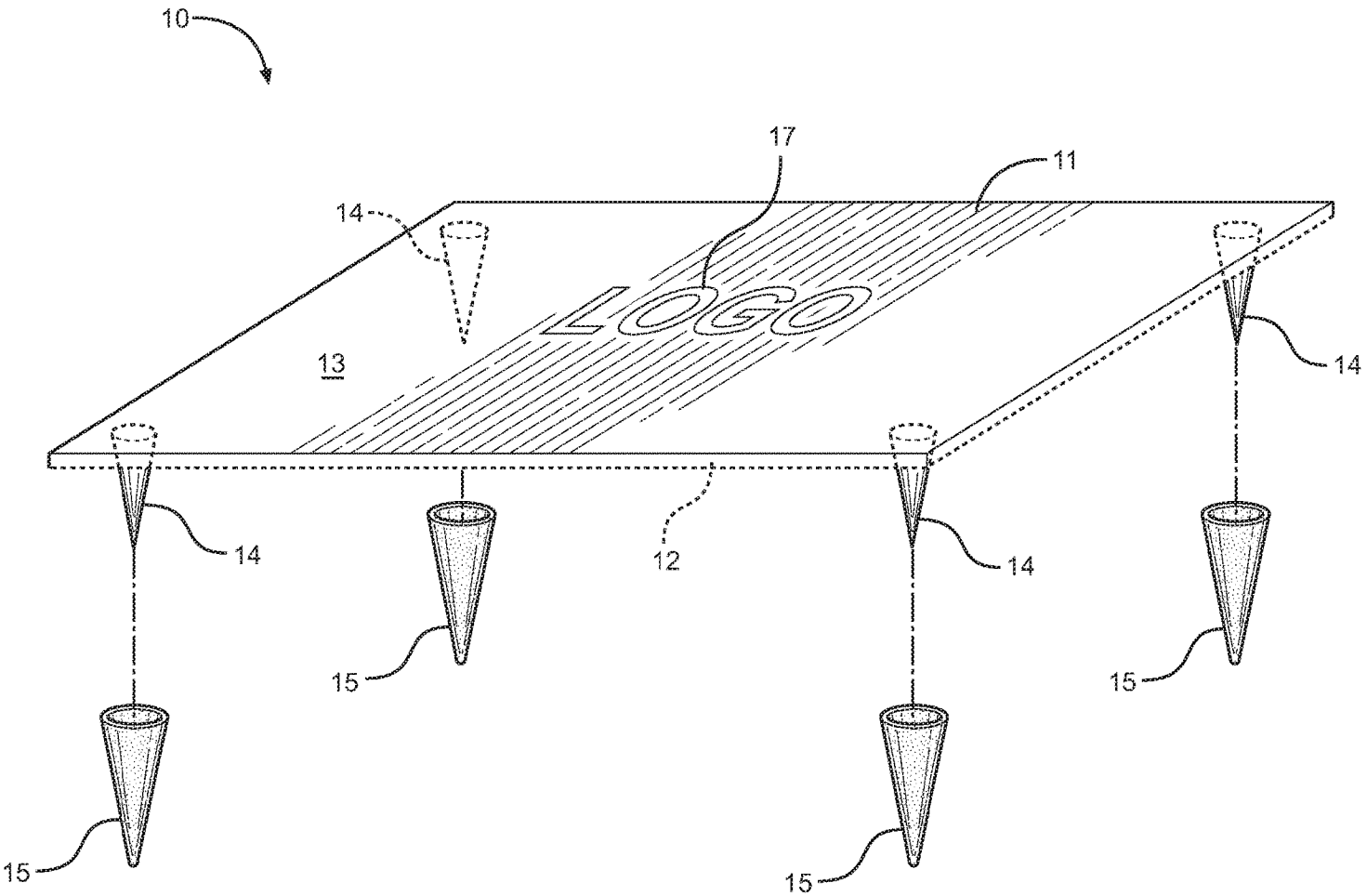
FIG. 1 shows an exploded perspective view of an embodiment of the takeoff point marker.

Reference is made herein to the attached drawings. Like reference numerals are used throughout the drawings to depict like or similar elements of the takeoff point marker. The figures are intended for representative purposes only and should not be considered to be limiting in any respect. Unless specifically limited to a single unit, "a" is intended to be equivalent to "one or more" throughout the present disclosure.

Referring now to FIG. 1, there is shown an exploded perspective view of the takeoff point marker. The takeoff point marker assembly 10 comprises a planar member 11 having a top surface 13 and a bottom surface 12. In the illustrated embodiments, the planar member 11 is a rectangle; however, in alternate embodiments the planar member comprises any suitable shape so as to receive print thereon. The top surface 13 is configured to receive print 17 thereon. The print 17 can take the form of a design or wordmark. The print 17 can vary for each embodiment of the takeoff point marker assembly 10, making the takeoff point marker assembly unique to an individual track and field athlete, for example an athlete can print a custom color pattern and a name on the top surface 13. The print 17 can be any dyed medium that adheres to a flat surface, for example, an oil paint that adheres to a plastic or metal planar member 11.

A plurality of spikes 14 is affixed to the bottom surface. In the illustrated embodiment, each spike 14 is a cone that tapers away from the bottom surface. However, in other embodiments the plurality of spikes 14 takes other forms, such as a pyramidal shape. In certain embodiments where the planar member 11 is a rectangle, such as the embodiment shown in the illustrations, the plurality of spikes 14 comprise four spikes, wherein each spike 14 is affixed to the bottom surface 12 within a corner of the planar member 11.

Figure 2:
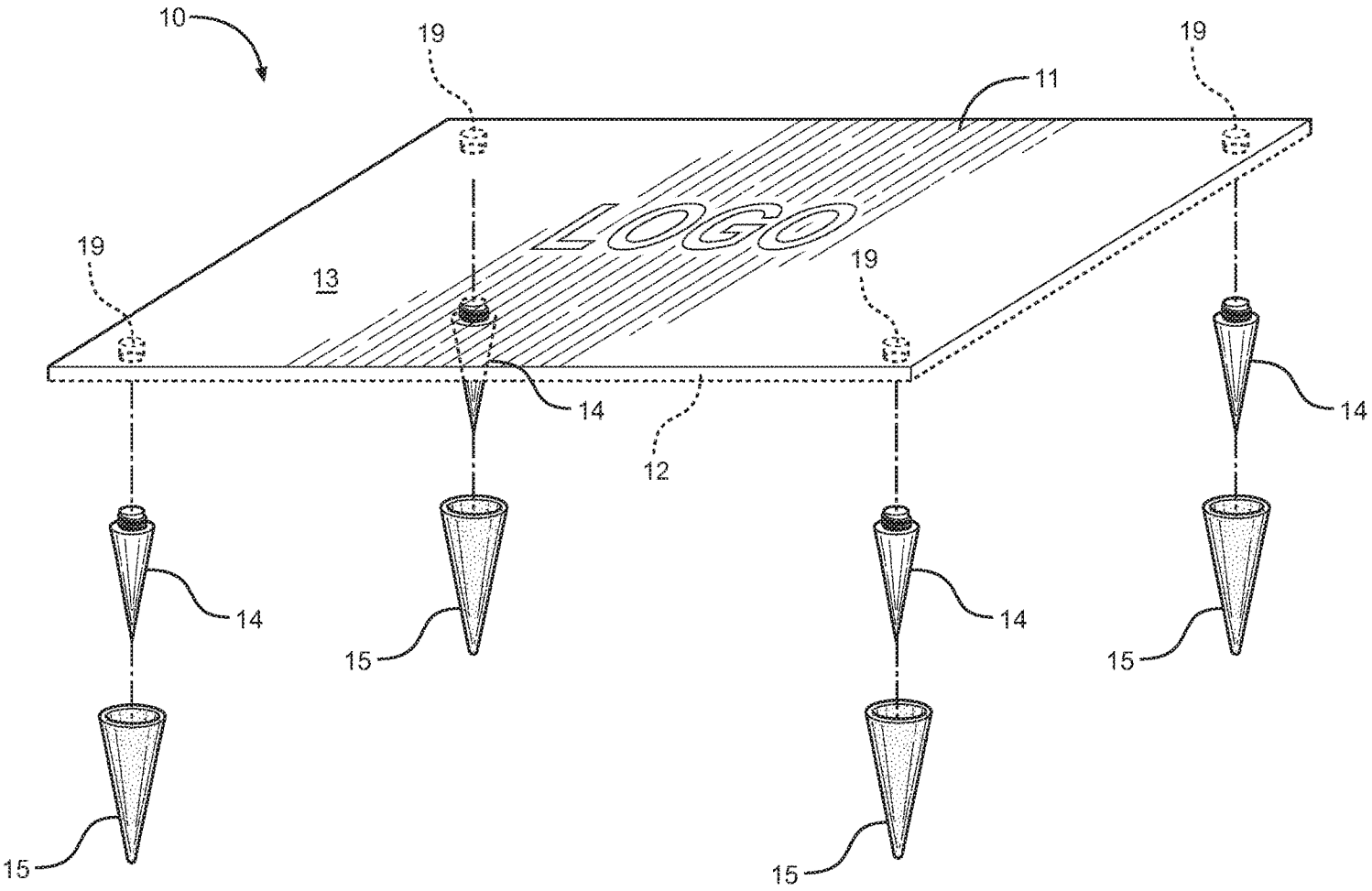
FIG. 2 shows an exploded view of the connection between the covers, spikes and planar member of an embodiment of the takeoff point marker.

Each spike 14 affixed to the bottom surface is configured to penetrate a track surface. In certain embodiments, as shown in FIG. 2, the plurality of spikes 14 is affixed to the bottom surface with a threaded connection. In these embodiments, the base of each spike 14 is threaded into a cavity 19 in the planar member 11. The cavity 19 is disposed on the bottom surface 12 and does not extend to the top surface 13 to maintain a planar top surface 13. The diameter of the base of each spike 14, in some embodiments where the plurality of spikes 14 are cones, is ¼ inch, or the standard diameter of a track shoe spike base. This arrangement allows a user to exchange spikes 14 if they become dull or damaged. In these embodiments, the length of each spike 14 can vary between 3/16 inch and ½ inch. This length range encompasses the standard length of a track shoe spike and allows the planar member 11 to be inserted into a track surface by pressing on the top surface 13 with the weight of a user.

A plurality of covers 15 is configured to house the plurality of spikes 14. In the illustrated embodiment, each cover 15 is a hollow cone. When a cover 15 is placed over a spike 14, the outer surface of the spike 14 and the inner surface of the cover 15 engage with a frictional coefficient greater than 1. Thus, the plurality of covers 15 are frictionally secured to the spikes 14. Additionally, the apex of each cover 15 is dull, i.e. a rounded nub, to prevent the spike 14 from injuring a person that may contact the bottom surface of the planar member.

Figure 3:
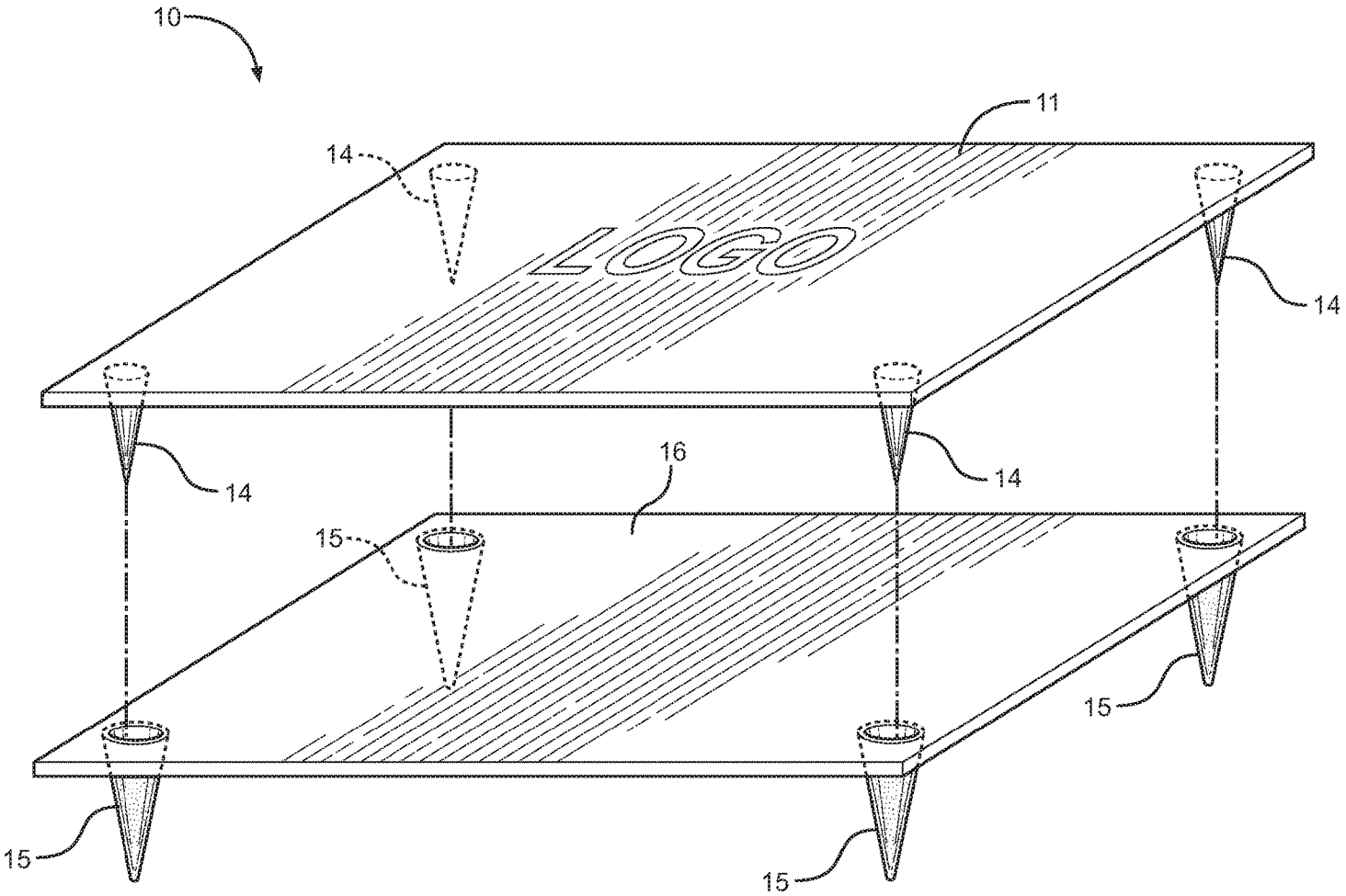
FIG. 3 shows an exploded perspective view of a second embodiment of the takeoff point marker.

Referring now to FIG. 3, there is shown an exploded perspective view of an alternate embodiment of the takeoff point marker assembly. In this illustrated embodiment, the plurality of covers 15 are inset within a planar cover member 16. The openings of the inset covers 15 are disposed on the upper surface of the planar cover member 16. The inset covers 15 extend and taper down, away from the upper surface of the planar cover member 16. Each cover 15 inset within the planar cover member 16 aligns with a spike 14 in the planar member 11. The planar cover member 16 fits flush against the bottom surface 12 of the planar member 11 when the plurality spikes 14 is inserted into the inset plurality of covers 15. In the illustrated embodiment, the planar cover member 16 is the same length and width as the planar member 11.

Figure 4:
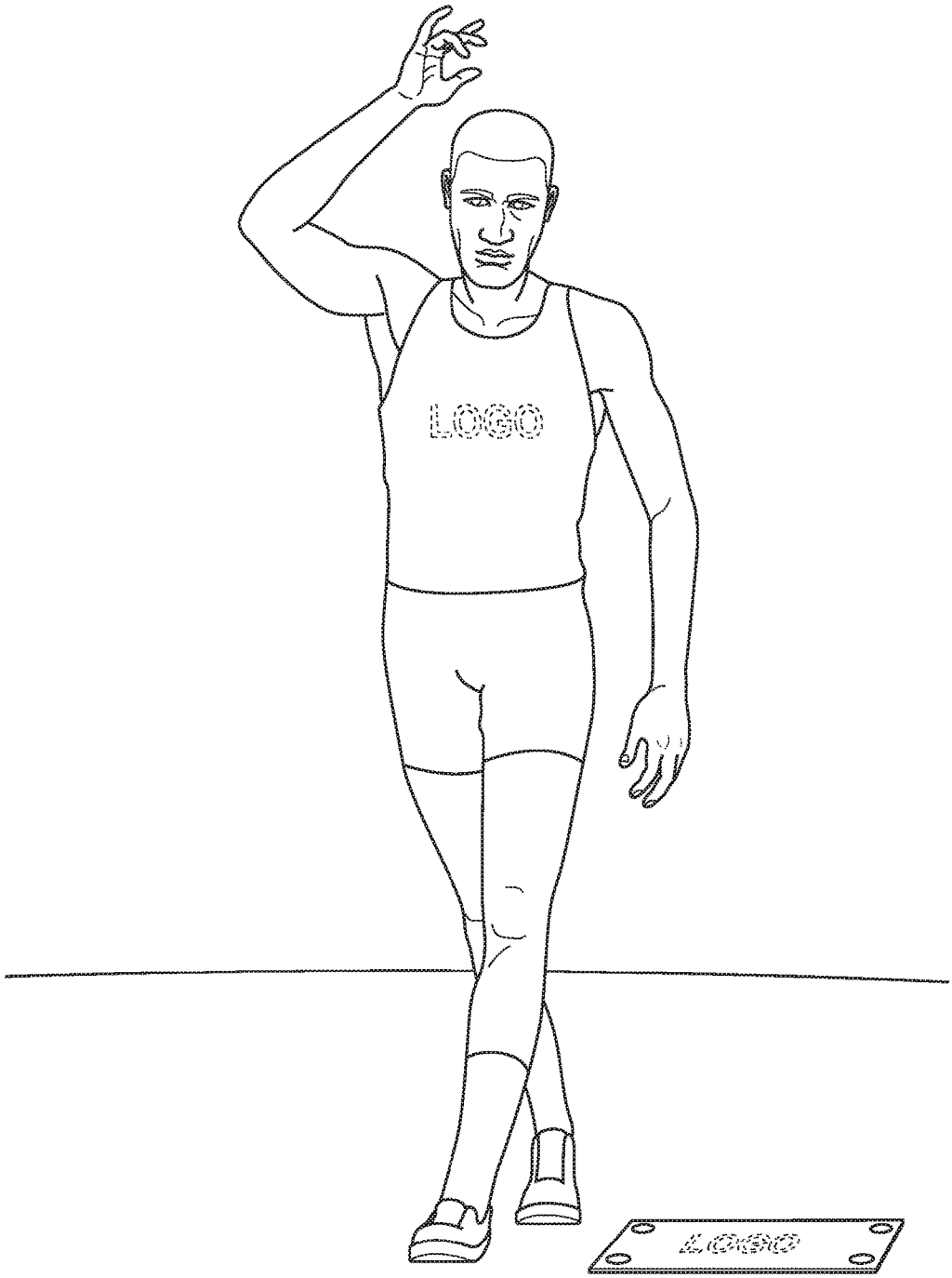
FIG. 4 shows a perspective view of an embodiment of the takeoff point marker implanted into a track surface.

As shown in FIG. 4, the plurality of spikes 14 is configured to puncture the surface of a track 18, thereby inserting the planar member 11 into the surface of the track 18. When inserted into the surface of the track 18, the takeoff point marker 11 is oriented so that the top surface 13 faces upwards, allowing a user, e.g. a vaulter, to view the print 17 disposed on the top surface 13. The bottom surface 12 rests against the surface of the track 18, when the takeoff point marker 11 is inserted into the surface of the track 18.

The takeoff point marker is placed at the start of a takeoff run for a track and field event, such as the long jump. Additionally, the takeoff point marker can be placed at various checkpoints during the takeoff run.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A takeoff point marker assembly, comprising:

a planar member having a bottom surface and a top surface;

a plurality of spikes affixed to the bottom surface, wherein the plurality of spikes tapers away from the bottom surface of the planar member;

a distal end of the plurality of spikes defining a point, wherein the point is dimensioned to pierce a track;

a plurality of covers configured to house the plurality of spikes, wherein the plurality of covers is each removably securable to each of the plurality of spikes and wherein each cover of the plurality of covers is shaped to directly contour each spike of the plurality of spikes;

an indicia disposed on the top surface, the indicia configured to indicate a position on the track when engaged therewith.

2. The takeoff point marker assembly of claim 1, wherein the planar member is a rectangle.

3. The takeoff point marker assembly of claim 1, wherein the plurality of spikes is four spikes, wherein each spike of the plurality of spikes is positioned in a corner of the bottom surface of the planar member.

4. The takeoff point marker assembly of claim 1, wherein each of the plurality of spikes is a conical shape.

5. The takeoff point marker assembly of claim 4, wherein each of the plurality of covers is a conical shape.

6. The takeoff point marker assembly of claim 1, wherein the plurality of spikes is removably affixed to the bottom surface of the planar member.

7. The takeoff point marker assembly of claim 1, wherein a plurality of conical covers is inset depressions in a planar cover member, wherein the planar cover member is configured to fit flush against the bottom surface of the planar member when the plurality of conical covers is removably secured to the plurality of spikes.

8. The takeoff point marker assembly of claim 7, wherein the plurality of conical covers completely sheaths the plurality of spikes when received therein.

9. The takeoff point marker assembly of claim 1, further comprising a cavity disposed on the bottom surface, the cavity configured to removably receive a threaded end of at least one of the plurality of spikes.

10. A takeoff point marker assembly, comprising:

a planar member having a bottom surface and a top surface;

a plurality of spikes affixed to the bottom surface, wherein the plurality of spikes tapers away from the bottom surface of the planar member;

a distal end of each spike of the plurality of spikes defining a point, wherein the point is dimensioned to pierce a track;

a plurality of covers configured to house the plurality of spikes, wherein the plurality of covers is each removably securable to each of the plurality of spikes and wherein each cover of the plurality of covers is shaped to directly contour each spike of the plurality of spikes;

wherein the plurality of covers is inset depressions in a planar cover member, wherein the planar cover member is configured to fit flush against the bottom surface of the planar member when the plurality of covers is removably secured to the plurality of spikes.

11. A takeoff point marker assembly, consisting of:

a planar member having a bottom surface and a top surface;

a plurality of spikes affixed to the bottom surface, wherein the plurality of spikes tapers away from the bottom surface of the planar member;

a distal end of each spike of the plurality of spikes defining a point, wherein the point is dimensioned to pierce a track;

a plurality of covers dimensioned to house the plurality of spikes, wherein each cover of the plurality of covers is conical, such that each cover of the plurality of covers corresponds to a shape defined by each spike of the plurality of spikes.

* * * * *